United States Patent [19]

Bresko

[11] Patent Number: 4,998,891

[45] Date of Patent: Mar. 12, 1991

[54] HOLDER FOR MAINTAINING ELECTRICAL CONNECTIONS

[76] Inventor: Joseph R. Bresko, 5315 Cleveland St., Hollywood, Fla. 33021

[21] Appl. No.: 267,355

[22] Filed: Nov. 4, 1988

[51] Int. Cl.[5] ..... H01R 13/627

[52] U.S. Cl. ..... 439/369; 439/367

[58] Field of Search ..... 439/367–369, 439/371, 350, 351, 353

[56] References Cited

U.S. PATENT DOCUMENTS 3,133,777 5/1964 Anhalt ..... 439/350

3,484,736 12/1969 Wyse ..... 439/369

4,784,612 11/1988 Ryan ..... 439/369

*Primary Examiner*—Gary F. Paumen

*Attorney, Agent, or Firm*—John Cyril Malloy

[57] ABSTRACT

A two-piece, shell-like holder composed of two telescopically mating shell portions sized to be connected together and to maintain a male and a female plug in electrical engagement with one another so that the interconnected shell structure assumes axial forces applied to and tending to separate the electrical connection and wherein the shell portions include interlocking portions when in telescopic engagement which an be unlocked by rotating the shell portions relative to one another and separating them axially.

5 Claims, 2 Drawing Sheets

HOLDER FOR MAINTAINING ELECTRICAL CONNECTIONS

FIELD OF THE INVENTION

This invention relates to a shell-like structure for maintaining a mated male and female electrical plug in electrical engagement with one another.

BACKGROUND OF THE INVENTION

In the past it has long been recognized that there is a need for a device for use in maintaining an electrical connection of interconnected male and female electrical plugs so that the electrical connection is maintained when axial forces are applied on the conductors to which the plugs are attached. It will be appreciated that, for example, a person using an appliance, such as a hedge trimmer or an electrical drill, first inserts an electrical plug on a short "pigtail" on the appliance into a mating plug of an extension cord only to be confronted repeatedly with the resulting electrical connection being broken each time axial forces are applied to the appliance pigtail. Yet, in use, one must move the appliance often and hence pull upon it putting an axial strain on the pigtail and electrical connection. This invention is of a device to encapsulate the electrical plugs in such a manner so as to assume axial loads applied on the conductors which tend to separate the electrical connection.

REPRESENTATIVE PRIOR ART

Representative prior art is found in the following U.S. Patents: U.S. Pat. No. 3,014,194 is of a cable connector protector which includes a shell-like structure which is retained in locked position by use of pull-tabs which extend across the top of a slide at locations near the ends. U.S. Pat. No. 3,030,601 is of an electrical cord connector which utilizes clamps and a longitudinally extending slit in a sleeve of rubber. U.S. Pat. No. 3,048,810 is of a coupling for electrical plugs which defines a receptacle within which the plugs are received and then locked into position by tie means. U.S. Pat. No. 4,221,449 is of a locking device which includes an elongate member with sockets on the end thereof to receive the lead conductor. U.S. Pat. No. 3,999,826 is of a device which includes a receptacle with a structure on the opposite ends to receive a barb to hold the device in assembly. U.S. Pat. No. 2,406,567 is of a holder for electrical connectors which is adjustable lengthwise to open and close the same. U.S. Pat. No. 4,145,105 is of a multi-piece assembly which includes a locking device for interlocking a receptacle and a connecting portion together. U.S. Pat. No. 4,440,465 is of a bifurcated portion on one lead conductor to interconnect with companion locking means on a mating electrical plug. U.S. Pat. No. 4,664,463 is of an adjustable size receptacle into which a mating pair of electrical plugs may be inserted.

SUMMARY OF THE INVENTION

This invention has as an object the provision of a shell-like structure to encapsulate mating electrical plugs and to assume axial loads so that the electrical connection is not repeatedly broken in use. The shell-like structure is composed of a pair of mating shell portions each sized and configured to contain one of the electrical plugs and to be telescopically interconnected and held in telescoped interconnection by locking means composes of a) spaced barbs on the exterior surface of one of the shell portions, and b) mating slots in the wall of the other and mating shell portions in which the barb-like portions are captivated when the shell portions are telscopically interconnected by axial movement of them. The barbs each include a proximal surface which extends radially outwardly on the inner shell portion. These barbs snap into one of the mating slots. Each barb also has inclined circumferentially facing side surfaces which converge toward one another from the surface of the inner shell portion so that, when the shell portions are telescopically interconnected with the barbs engaged in the mating and registered slots, the shell portions can be unlocked by rotating the shell portions relative to one another with the inclined circumferentially facing side surfaces riding out of the slots.

It is a general object of this invention to provide a device which is simple and inexpensive to make, easy to install and is efficient in that it assumes the axial load applied to an electrical connection composed of mating male and female electrical plugs so that the electrical connection is not broken.

In accordance with this general object and the structure as described and claimed hereinafter, the instant invention will now be described with reference to the accompanying drawing in which:

DESCRIPTION OF THE PREFERRED EMBODIMENT

Figure 1:
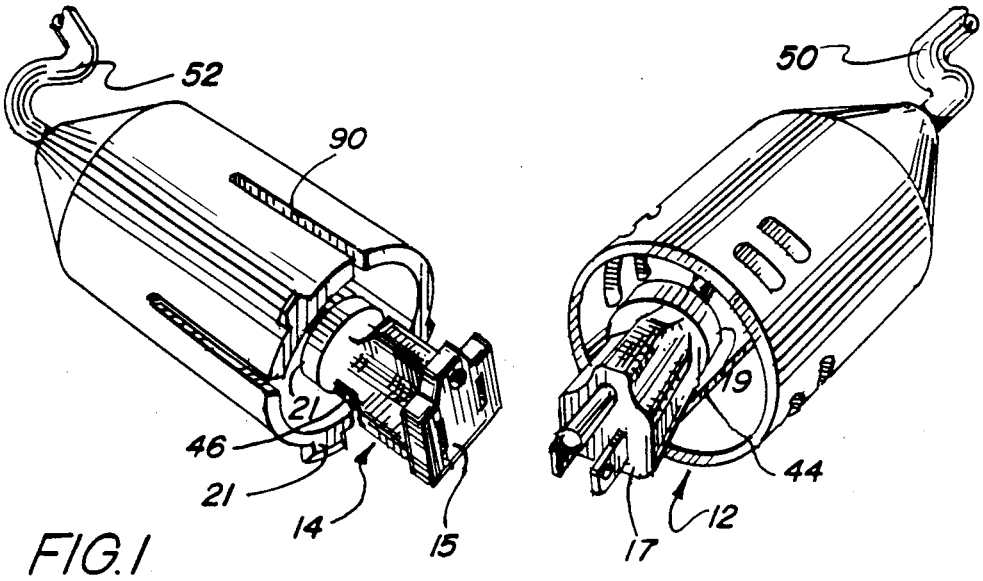
FIG. 1 is a perspective view of the shell-like structure to maintain electrical plugs in electrical engagement with one another.

Referring to the drawings wherein like reference characters designate like or corresponding parts throughout the several views and referring generally to FIG. 1, it is seen that there is a male electrical plug generally designated by the numeral 12 and a female electrical plug generally designated by the numeral 14 which are intended to be electrically interconnected with one another in male-female relationship. Each of the plugs is of a predetermined axial length between the outer or distal axial face 15, 17 and an inner or proximal face 19, 21. When interconnected these plugs have an overall axial length between the proximal faces. The shell-like structure which encapsulates the interconnected plugs will now be described. The shell-like structure is sized and configured to receive the electrical plugs when in mating electrical engagement.

Figure 2:
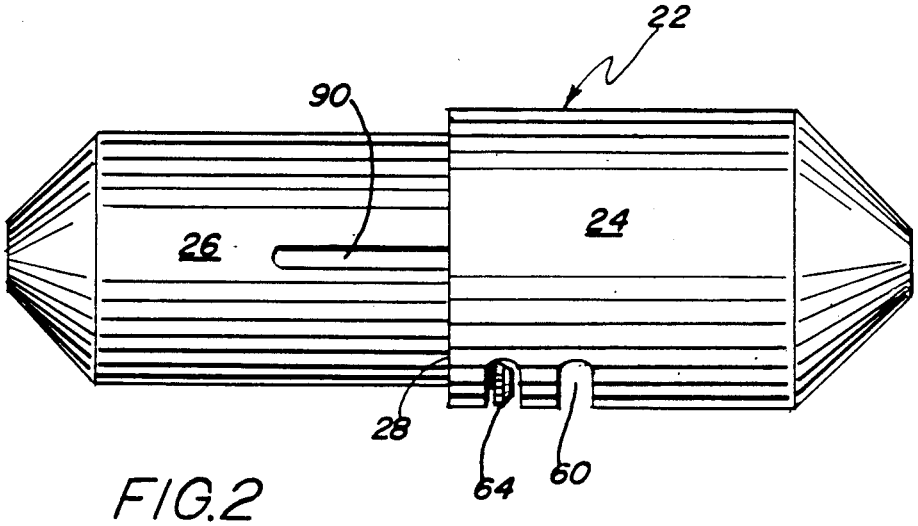
FIG. 2 is a side view of the shell-like structure when assembled.

The shell-like structure is generally designated by the numeral 22 in FIG. 2. It is composed of a first and second mating cup-shaped shell portion one of which is designated by the numeral 24 and the other of which is designated by the numeral 26. Each of the shell portions has a leading edge or rim face on the outer end 28 and 30. A tubular portion 32, 34, and an inner end or a base 36 and 38. In the base of each of the shell portions there is a through hole as at 40 and 42. Extending from the through hole of each shell portion to the rim, a slit is provided as at 44, 46. It is thus seen that by virtue of the slit in each of the shell portions, they are each adapted to receive one of the plugs therein with the electrical conductor or lead portion of each plug, 50 and 52, being insertable through the slit. In use, one of the shell portions is assembled on one of the electrical conductors by inserting one of the conductors through the slit 44 or 46 and into the shell portion into generally coaxial alignment of the plug and conductor with he shell portion. Then, the plugs are mated in electrical engagement and the shell portions are then telescopically moved together to encapsulate the electrical connection. The interior of the shell portions are each sized so that the interior surface of the end of each of the shell portions, that is their bases, bear against the inner or proximal face of the electrical plug within it. This holds the plugs in electrical engagement with one another. Means are provided to maintain the shell portions in telescoped relation with one another so that in response to axial forces on the conductors, tending to break the electrical connection, the load will be assumed by the shell-like structure and the electrical connection will not be broken. The means to maintain the shell portions in telescoped relation will now be described.

Figure 3:
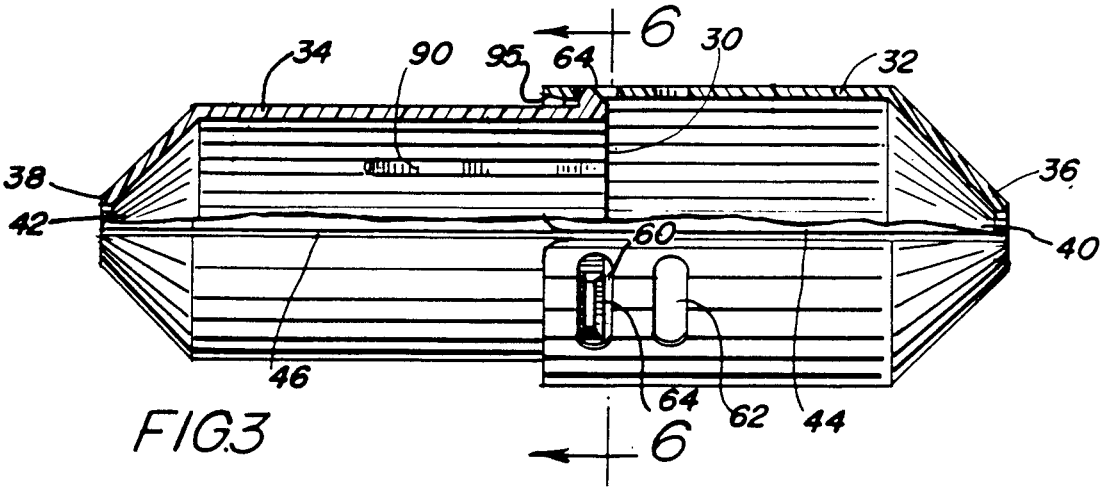
FIG. 3 is a view partly in cross-section of the structure shown in FIG. 2.
Figure 4:
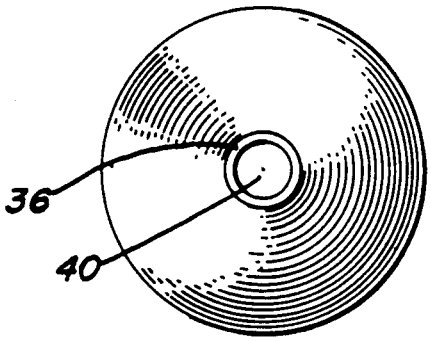
FIG. 4 is a right side end view of the structure shown in FIG. 1.
Figure 5:
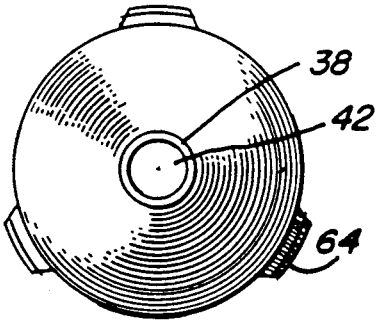
FIG. 5 is a view of the left side end view of the structure shown in FIG. 1.
Figure 6:
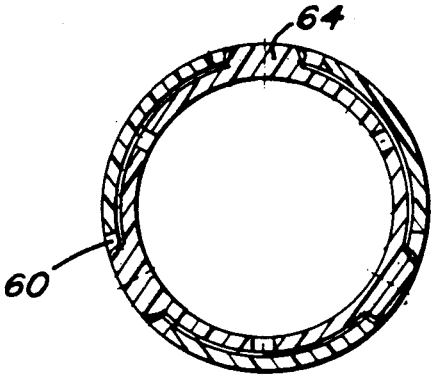
FIG. 6 is a view in cross-section taken on the plane indicated by the line 6—6 of FIG. 2 and looking in the direction of the arrows.

In the preferred embodiment, the mans to connect the shell portions comprise a ring of openings or slots adjacent the rim face 28 of the outer shell portion 24, such as those designated by the numerals 60 and 62 in FIG. 3. The slots are equiangularly spaced in each ring and each is preferably elliptical in shape with its major axis extending circumferentially. These slits or elliptical openings receive barbs such as that designated by the numeral 64 on the rim edge of the second or inner shell portion 26. Generally, the barbs 64, see FIG. 7, on the rim edge 30 are raised portions with an outer surface 66, see FIG. 7, and a distal surface 68 which is inclined rearwardly from the end face 68' to define an inclined plane. Also, on the barb the circumferentially facing surfaces, such as that designated by the numeral 70 are inclined from the surface of the tubular portion toward the outer surface 66 of the raised portion. This configuration permits axial mating telescopic movement of the shell-like portions toward one another until the barbs are captivated in the registering and mating slots, and, secondly, relative rotation of the shell-like portions when they are interlocked which permits the barbs to ride out of the slots to separate the shell-like portions by axial movement.

It will be seen that the second shell portion is provided with a plurality of radially spaced slits such as 90 so that, when the tubular portion 34 of the second or inner shell portion is grasped relatively tight, the rim edge 30 will collapse somewhat to become of a reduced diameter to accommodate shell portions being telescoped together into locking engagement now to be described. As the rim 30 of the inner or second shell portion is inserted in the other shell portion, while being grasped tightly, the inclined face 68 on each of the barbs or raised portions will easily move axially until snapping into engagement in one of the mating elliptical openings. In the preferred embodiment, as best seen in FIG. 3, the mouth of the outer shell-like portion 24 has an inside surface 95 at the rim 48 which is inclined somewhat as shown to provide ease of entrance.

In use, it is thus seen that there is provided an effective shell structure to encapsulate a pair of mating electrical plugs and to assume axial forces so that the electrical connection is not broken.

Figure 7:
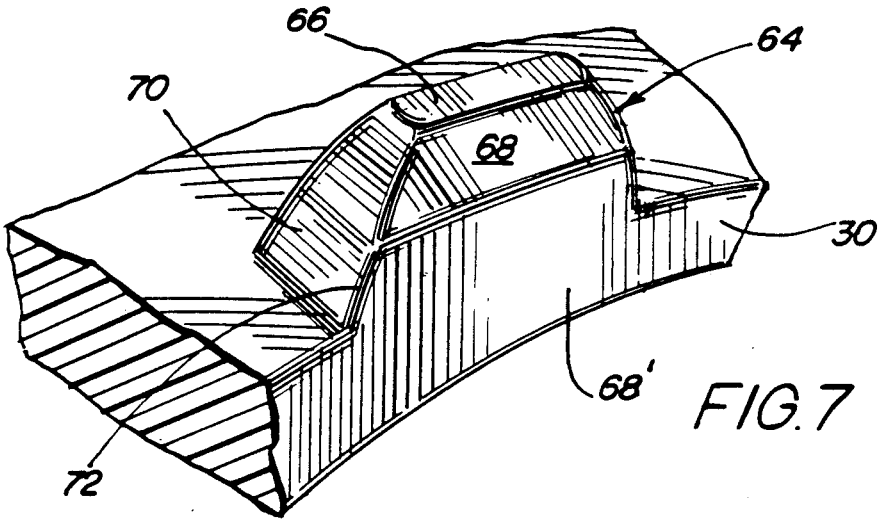
FIG. 7 is a partial perspective view of the end of one portion of the shell-like structure.

In the preferred embodiment, there are preferably several rings of openings, two being shown in the drawings. This is so that the telescopic action may be increased or decreased depending upon the size of the plugs which are electrically connected. It has been found that an overall dimension of the first shell portion of about 3 inches and an overall dimension of about 3.35 inches for the second shell portion provides a shell structure of a satisfactory overall internal or cavity length to accommodate most electrical connections, when the two are in mating electrical engagement and the centerline of the distal-most ring of elliptical openings is about 0.25 inches from the rim. In the preferred embodiment, the material of the shell portions is polypropylene; however, other rigid materials may be utilized within the relatively rigid range. The distal face of the barbs or enlarged portions, see FIG. 7, is inclined proximally at about 30° to provide an inclined plane. In the preferred embodiment there are three elliptical openings in each ring through the wall thickness of the tubular portion. It has been found that an opening in the base of the shell portions of about $\frac{3}{8}$ inch to $\frac{1}{2}$ is satisfactory for most conductors. A shell structure in accordance with this invention generally with the dimensions set forth accommodates universally the types of electrical plugs commonly encountered on drills and other household appliances which have "pigtails."

The circumferential faces of the barbs or raised portions on the inner shell portion are also inclined at an angle of about 30° as shown to provide smooth inclined planes for rotating the shell-like portions relative to one another when disconnecting the shell portions. In the preferred embodiment, there are three elliptical openings in each of two rings of openings around the periphery of the outer shell portion, whereby the overall cavity length in the connected shell portions can be varied by sliding the raised portions out of one ring of openings and into another ring of openings along the length of the outer shell portion.

Accordingly, applicant's invention comprises a shell-like structure having the general dimensions and features as described above and as more particularly claimed hereinafter, wherein the shell structure is able to universally accommodate the various types of electrical plugs commonly encountered in the field of electrical devices.

While the instant invention has been shown and described in what is considered a practical and preferred embodiment, it is recognized that departures may be made therefrom within the spirit and scope of this invention which is, therefore, not to be limited except as set forth in the claims hereinafter and in accordance with the doctrine of equivalents.

What is claimed is:

1. For use with the combination of (a) a male electrical plug (12) with a first lead conductor (50) and (b) a female electrical plug (14) with a second lead conductor (52), wherein the plugs (12), (14) each have an axial, proximal face (19), (21) and a distal face (15), (17) and when the plugs are in electrical engagement the distance between the proximal faces is of a predetermined distance, a shell-like structure (22) to maintain the plugs in electrical engagement with one another comprising, (a) a first and a second cup-shaped mating shell portion (24, 26), said first shell portion (24) having a rim (28) defining an open first mouth of a first diameter, said first shell portion being of a depth to receive one of the plugs (12), said first shell portion (24) including a base (36) with a through hole (40) and a tubular portion (32) extending from the base to the rim (28), said first shell portion further including an elongate slit (44) extending from the, hole (40) axially to the open mouth for insertion of the lead conductor (50) on said one of the plugs (22), said tubular portion (32), adjacent the rim (28), having a plurality of equiangularly spaced, generally elliptically shaped openings at a common distance from the rim, said second shell portion (26) having a second rim edge (30) defining a second mouth of a second diameter smaller than the first diameter of the first shell portion, said second shell portion being sized for receipt of the rim edge (30) through the first mouth and into the first shell portion in telescoping relation and being of a depth to receive the other of said plugs, said second shell portion including a base (38) having a through hole (42) and a tubular portion (34) extending from the base (38) to the rim edge (30), said second shell portion including a slit (46) extending from the hole (42) in the base (38) to the mouth for insertion of the lead conductor (52) on the other of said plugs, said second shell portion further including a plurality of raised portions (64) exteriorly on the tubular portion (34) at the rim edge (30), each of said raised portions being equiangulary spaced from one another for registry with one of the openings in the first shell portion so that upon telescopic movement of the shell portions towards one another said raised portions are received and captivated in the openings, each of said raised portions including, an outer surface sized to nest in one of the elliptical openings, a distal surface (68) inclined from the rim edge (30) to the outer surface, a proximal surface extending generally radially from the tubular portion (34), and circumferentially facing surfaces (70) converging toward one another from the tubular portion (34) to the outer surface, whereby each of said raised portions, upon assembly of the shell portions, are sized to dwell in one of the elliptical openings with the proximal surfaces of the raised portions bearing against the elliptical openings in response to axial forces on the lead conductors so that the shell portions assume the axial load on the electrical plugs, said second shell portion having a plurality of axially extending slots (90) extending from the rim edge (30) toward the base (38), so that, when the tubular portion of the second shell portion is grasped tightly adjacent the rim edge (30), the diameter of the mouth of the second shell portion is reduced somewhat for ease of insertion into the open mouth of the first shell portion, said first and second shell portions being rotatable when in telescoped relation so that on relative movement of rotation, the inclined surfaces (70) of the raised portions ride out of the elliptical openings and the shell portions may be separated from one another by moving the same axially apart, and said shell-like structure being of relatively rigid plastic material which is bendable and yieldable within the range of its plastic memory so that, upon said axial forces being relaxed thereon, its original shape is maintained.

2. The shell-like structure as set forth in claim 1 wherein the overall axial length of the first shell portion is about 3 inches.

3. The shell-like structure as set forth in claim 1 wherein the overall axial length of the second shell portion is about 3.35 inches.

4. The shell-like structure as set forth in claim 1 wherein the elliptical openings are about 0.25 inches from the rim (28).

5. The shell-like structure as set forth in claim 4 wherein a second ring of elliptical openings is provided axially spaced a distance from said rim (28) about $\frac{1}{2}$ inch from said rim.

* * * * *